United States Patent [19]

Deniega

[11] 3,995,786

[45] Dec. 7, 1976

[54] INTERMEDIATE YARN FEEDING AND CONTROL DEVICE

[75] Inventor: Jose Castillo Deniega, Elmhurst, N.Y.

[73] Assignee: Wesco Industries Corporation, Plainview, N.Y.

[22] Filed: Jan. 15, 1975

[21] Appl. No.: 541,120

[52] U.S. Cl. ..... 242/47.01; 66/132 R; 139/453; 242/47.12; 242/128; 242/147 R

[51] Int. Cl.[2] ..... B65H 51/20

[58] Field of Search ..... 242/47.01, 47.12, 47.08, 242/47.09, 47.13, 47.1, 47.11, 128, 147 R; 66/132 R; 139/122 R; 57/58.83, 58.86

[56] References Cited

UNITED STATES PATENTS

| | | | |
|---|---|---|---|
| 2,128,487 | 8/1938 | Klein | 242/128 |
| 2,479,826 | 8/1949 | Frick et al. | 242/128 |
| 3,202,380 | 8/1965 | Hosbein | 242/128 |
| 3,284,024 | 11/1966 | Franzen | 242/128 |
| 3,425,647 | 2/1969 | Kovaleski et al. | 242/128 |
| 3,782,661 | 1/1974 | Deniega et al. | 242/47.12 |

*Primary Examiner*—Stanley N. Gilreath
*Attorney, Agent, or Firm*—Henry R. Lerner

[57] ABSTRACT

There is disclosed an intermediate yarn feeding and control device having a storage member adapted to have yarn wound thereabout adjacent one end thereof to form yarn windings which advance toward the other end thereof. Yarn guide means located adjacent the other end of the storage member is adapted to guide the yarn, selectively, into one of two separate paths of yarn travel. A restraining element restrains the yarn withdrawal to a preselected rate when the yarn is guided through one of the paths but is clear of the yarn travel when the yarn is guided through the other of said paths for permitting the yarn to be withdrawn from the storage member at any desired rate. The yarn guide means includes a plurality of outwardly extending resilient fingers whose free ends support an outer ring so that when the withdrawn yarn is guided through the one path which is inwardly of the outer ring, it flexes successive resilient fingers which impart thereto a preselected tension.

43 Claims, 12 Drawing Figures

INTERMEDIATE YARN FEEDING AND CONTROL DEVICE

BACKGROUND OF THE INVENTION

The present invention relates to intermediate filament or yarn storage and feeding devices used in association with textile producing apparatus, particularly knitting machines, but relating as well to weaving and spooling apparatus.

Storage feeding devices are well known in the prior art and comprise usually a storage element such as a drum, about which yarn is wound tangentially to form a supply of yarn or store thereon which is then removed axially in response to the demand of the textile producing apparatus. Such storage devices are also known as demand feeders since they make available to the textile producing apparatus the amount of yarn demanded thereby. Examples of such storage or demand feeders are shown in U.S. Pat. Nos. 3,225,446, 3,419,225, 3,648,939 and 3,780,958. During the axial withdrawal of the yarn from the storage member, it is desirable to retard the yarn by means of a retarding device so that the yarn being withdrawn has imparted thereto a constant uniform tension which is generally very low. Such retarding devices have assumed various forms in the prior art as for example a resilient ring such as shown in U.S. Pat. No. 3,225,446 or a base ring surrounding the storage drum and having flexible elements such as resilient fingers extending inwardly from the ring for engagement with the drum such as shown in U.S. Pat. Nos. 3,648,939 and 3,702,176.

As the yarn is axially removed from the storage member, it passes between the drum and the retarding device with the latter imparting to the yarn a retarding force and thus a predetermined tension intended to be uniform.

In accordance with the present invention, there is provided a retarding device which is of substantially improved construction and which is particularly well adapted for use in connection with a storage feeding device wherein the yarn which is axially withdrawn from the drum reverses direction and passes through a passageway within the storage drum on its way to the textile producing apparatus, such as shown in U.S. Pat. No. 3,780,958.

It is also known in the prior art to provide storage feeding devices which can be converted into positive feeding devices wherein the yarn, instead of being withdrawn axially, is withdrawn tangentially at a predetermined rate directly related to the rotational rate of the knitting machine. Examples of yarn feeding devices which can be selectively operated as storage feeding devices or positive feeding devices are shown in U.S. Pat. Nos. 3,782,661 and 3,796,384. It is another object of the present invention to provide greatly simplified means for enabling an intermediate yarn feeding device to be selectively operable either as a demand feeder wherein the yarn is axially withdrawn in response to the demand of the textile feeding apparatus, or as a positive feeder wherein the textile producing apparatus is positively fed a predetermined amount of yarn per unit of time, as determined by the rotational speed of the apparatus.

Summary of the Invention

In accordance with the invention, there is provided, in an intermediate yarn feeding device of the type wherein the yarn withdrawn from the drum adjacent the free end thereof reverses direction and passes through a passageway within the drum on its way to the textile producing apparatus, novel retarding means carried by the drum at the free end thereof. The retarding device comprises an inner ring from which outwardly extends a plurality of bristle-like resilient elements which project outwardly of the drum surface and whose free ends are received in a groove of an outer ring member which is supported by the resilient elements. When the device is operated as a demand feeder, the yarn withdrawn from the drum passes between the drum and the outer ring causing said yarn to progressively engage and flex successive resilient elements which impart to the withdrawing yarn the desired uniform low tension. When the yarn leaves its engagement with the resilient elements, it engages the outer surface of an end plate as it reverses direction to enter the passageway within the drum. The engagement of the yarn with said end plate imparts to such yarn a tortuous path which also defines a supplemental retarding force to the yarn engaged thereby. In accordance with one embodiment of the retarding device, the end plate is mounted for axial adjustment so that the tortuous path can be varied for selectively adjusting the overall tension imparted to the yarn. In accordance with another embodiment of the retarding device, means are provided for adjustably flexing the bristlelike resilient elements for selectively varying the tension imparted to the withdrawing yarn.

In accordance with another feature of the invention, the winding element is provided with a restraining portion which clears the path of the yarn when the yarn is passed through the resilient elements of the retarding member as is the case when the intermediate device is functioning as a demand feeder. When it is desired to operate the intermediate feeding device as a positive feeder, the yarn being withdrawn from the drum is rethreaded so as to pass outwardly of the outer ring member, out of engagement with the resilient elements, causing the yarn to travel in the path of the restraining member on the winding element which limits the withdrawal velocity of the yarn to a rate no greater than the rate at which the yarn is wound onto the drum, thus defining a positive feeding device.

Accordingly, the conversion from demand feed to positive feed is accomplished in a most simplified manner, requiring only the rethreading of the yarn from a path inwardly of the retarding device's outer ring to a path outwardly of said outer ring.

DESCRIPTION OF THE PREFERRED EMBODIMENTS

Figure 1:
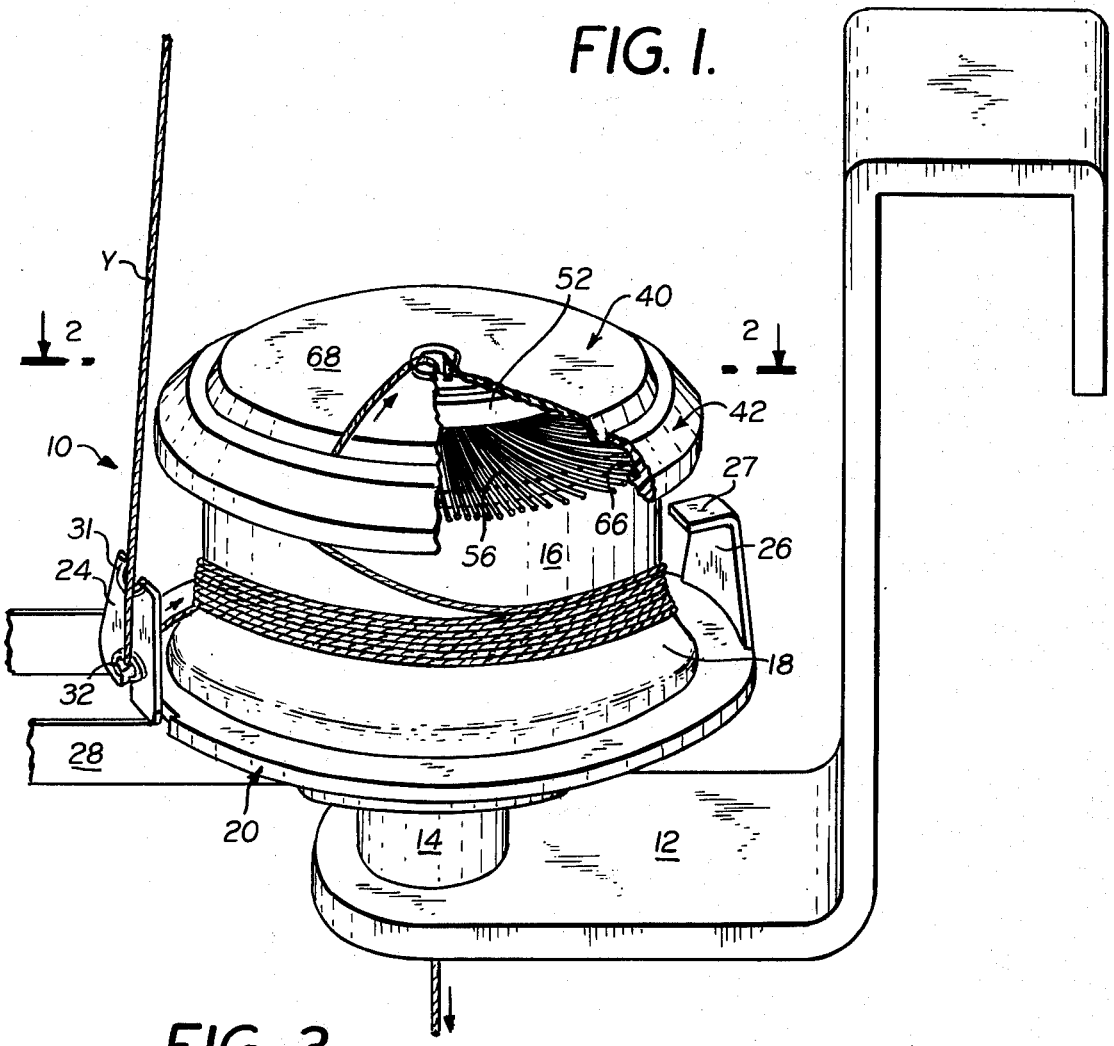
FIG. 1 is an elevational perspective view, with parts broken away, of a yarn feeding device in accordance with the invention.
Figure 2:
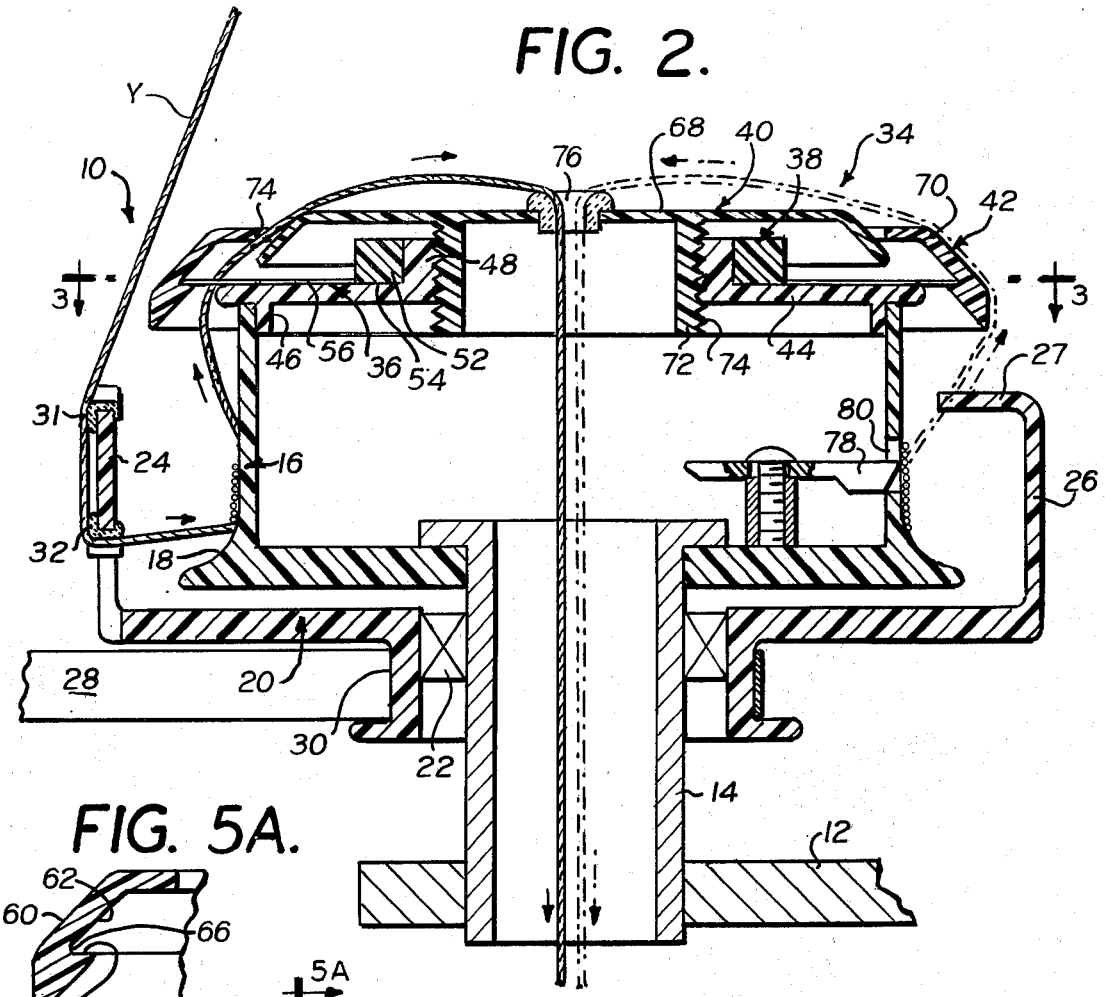
FIG. 2 is a sectional view taken along lines 2—2 of FIG. 1.

Referring now to the embodiments shown in FIGS. 1 to 5, numeral 10 identifies the intermediate feeder in accordance with the invention. Intermediate feeder 10 is carried by frame member 12 which is adapted in any suitable manner to be secured to the textile producing apparatus such as a knitting machine. Frame member 12 fixedly supports tubular member 14 which in turn fixedly supports stationary storage member 16 which is generally drum shaped and is provided at the inner end thereof with a generally conical section 18. A winding member 20 is mounted for rotation by means of bearing 22, about tubular member 14, and includes posts 24 and 26, respectively, extending axially of storage member 16 and radially spaced therefrom, with post 26 having an inwardly extending portion 27. Winding member 20 is adapted to be rotated about stationary storage drum 16 by belt 28 in driving engagement with pulley portion 30 of winding member 20. Yarn Y from a supply thereof is guided outwardly of axially extending post 24 through split eyelet guides 31 and 32, as best shown in FIG. 2, adjacent conical section 18 of storage member 16.

In a manner well known in the art, rotation of winding member 20 about storage member 16 causes the yarn wound upon conical section 18 to form windings on the storage member which advance towards the free end thereof. While storage member 16 is illustrated as having conical section 18 for advancing the windings axially of the drum, it will be understood that other means may be provided on the drum for axially advancing the yarn windings such as a tilted disk in the form shown in U.S. Pat. No. 33,419,225.

Figure 4:
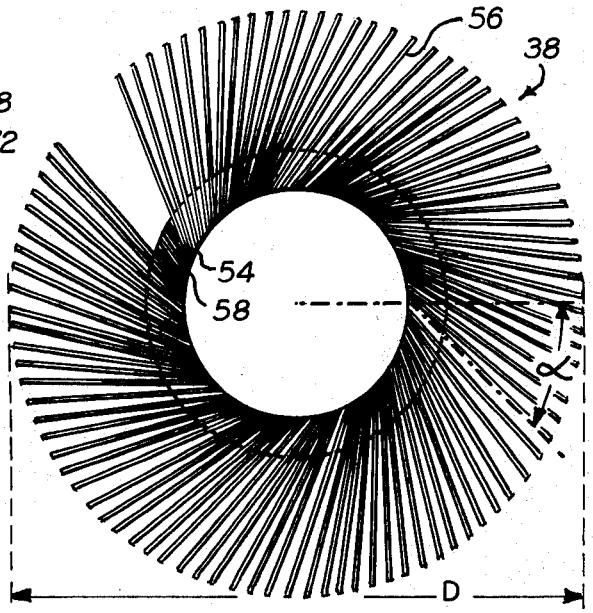
FIG. 4 is a bottom plan view of the resilient finger carrying member in accordance with one embodiment of the invention, with some fingers removed for purposes of illustration.
Figure 5A:
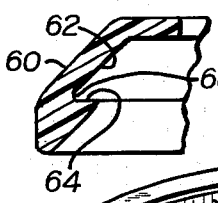
FIG. 5A is a sectional view, on an enlarged scale, taken along lines 5A—5A of FIG. 5.
Figure 5:
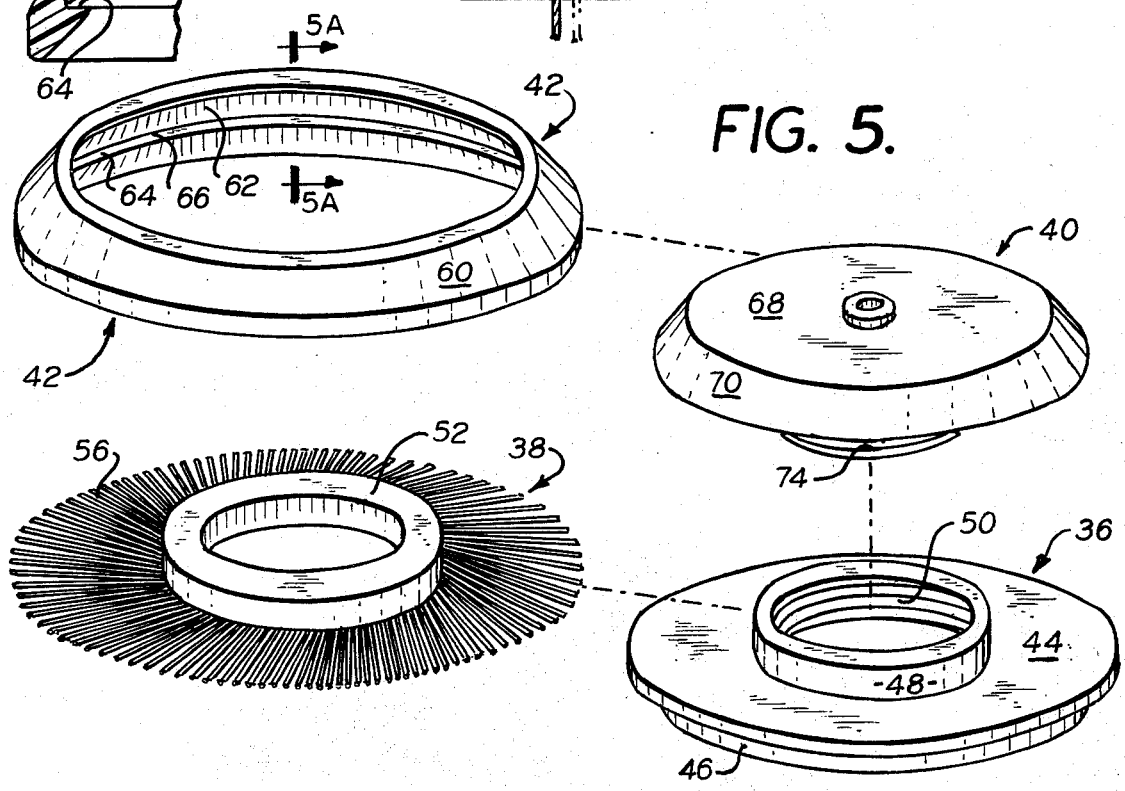
FIG. 5 is an exploded view of the retarding device in accordance with one embodiment of the invention.

Storage member 16, which is illustratively shown as being generally hollow, is provided at the outer or free end thereof with retarding device 34 comprising storage member cover plate 36, resilient finger carrying member 38, end plate 40, and outer ring member 42, all of which are best shown in the exploded view of FIG. 5. Cover plate 36 comprises annular disk 44, peripheral skirt 46 and hub 48 internally threaded as at 50. Cover plate 36 is adapted to be press fit into the open end of storage member 16 and disk 44 has a diameter slightly larger than that of storage member 16 and thus projects outwardly therefrom. Bristle-like resilient fingers carrying member 38 comprises annular element 52, the bottom surface 54 of which, as best shown in FIG. 4, is provided with a plurality of outwardly and angularly extending resilient fingers 56. In order to secure resilient fingers 56 to annular element 52, said bottom surface 54 is provided with narrow grooves 58 within which are received the ends of resilient fingers 56 which are retained in said grooves by means of a suitable adhesive. In the preferred embodiment illustrated in the drawings, annular member 52 is provided with 96 equally spaced generally rectilinear fingers 56, each of which forms the angle $\alpha$ with a line normal to the annular member at the inner end of the finger, which angle $\alpha$ is preferably 45°. The inner diameter of finger carrying member 38 is substantially the same as the outer diameter of the hub 48 of cover plate 36 so that finger carrying member 38 can easily be placed about said hub and supported by disk 44.

The length of resilient fingers 56 is such that their extremities collectively define an outer diameter D which is greater than the outer diameter of disk 44 whereby fingers 56 project outwardly thereof when annular member 52 is supported thereon.

Figure 3:
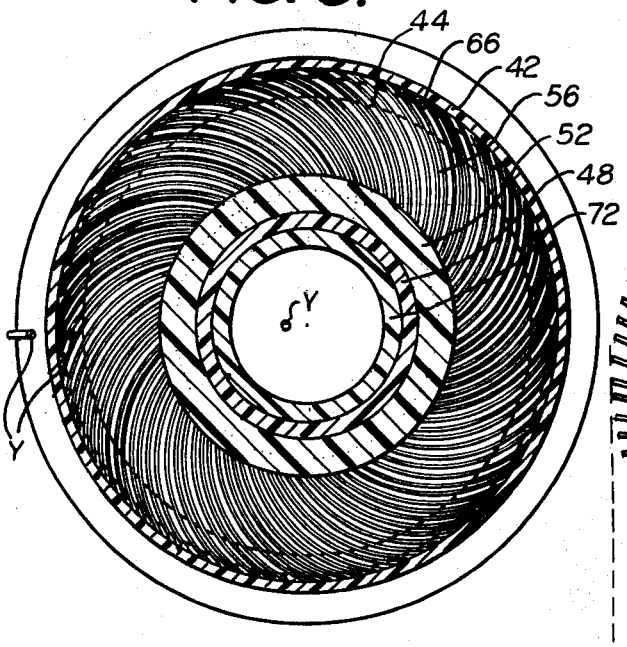
FIG. 3 is a sectional view taken along lines 3—3 of FIG. 2.

Outer ring member 42 has a smooth outer peripheral side wall 60, an inner peripheral side wall 62 and lateral shoulder 64, said side wall 62 and shoulder 64 being joined as at 66 to define a finger receiving seat whose diameter is smaller than diameter D defined collectively by the outer extremities of fingers 56. Accordingly, when outer ring 42 is placed over finger carrying member 38 and pressed downwardly, fingers 56, which are resilient, are forced to curve inwardly, bypassing shoulder 64 and snapping back into seat 66 wherein they remain in curved condition while providing the sole means of support for outer ring 42 as best shown in FIG. 3.

End plate 40, which forms the last element of yarn retarding device 34 includes top wall 68, a smooth outer side wall 70 and hub 72 threaded as at 74 so as to be threadable within hub 48 of cover plate 36. Side wall 70 and outer ring 42 are appropriately dimensioned so as to define a passageway 74 therebetween.

When the various components forming retarding device 34 are assembled together as aforedescribed, it will be evident that, when intermediate feeder 10 is used as a demand feeder, wherein the yarn is withdrawn axially as demanded by the textile producing knitting machine, the yarn demanded by the machine is unwound from storage member 16, passes between cover plate 36 and outer ring 42, displacing, in the process, successive resilient fingers 56 which are flexed by the withdrawing yarn, such flexing subjecting the yarn to the uniform desired tension. In this connection, and as best shown in FIG. 1, it is apparent that finger carrying member 38 and fingers 56 are disposed so that said fingers are angularly oriented in the direction of yarn withdrawal. As the yarn passes between successive resilient fingers, it continues its travel in engagement with side wall 70 of end plate 40, enters central aperture 76 in said end plate, reverses direction as it travels through the storage member on its way to the textile producing machine. End plate 68, being axially adjustable relative to cover plate 36, enables selective adjustment of the tortuous path of the yarn in engagement with said end plate, thus providing a supplementary means for varying the tension on the yarn.

In the operation of the intermediate feeding device 10 as a storage feeder, it will be understood that yarn windings within a predetermined range are continuously maintained on storage member 16 by means of a feeler member 78 extending through a slot 80 in storage member 16 which is operative, in ways well known in the art, to detect the yarn stored on the storage member and be operative to conrol the winding means so as to maintain said predetermined range. Neither the detecting mechanism nor the means for controlling the yarn winding means, both of which are well known in the art, form part of the present invention.

While in the preferred embodiment, the bristle-like resilient fingers are made of nylon, other materials such as wire or natural stiff hair can be used, it being understood of course that the tension imparted to the yarn will be a function of the resiliency of the fingers and that the stiffer the fingers, the more resistance they will present to the yarn which flexes the fingers as it is withdrawn. Similarly, while the angle $\alpha$ has been described in the preferred embodiment as being 45°, such angle can be reduced or increased to impart more or less tension, respectively, to the exiting yarn. Finally, the number of resilient fingers utilized as well as their length which defines D constitute other variables which can be preselected as may be desired to impart a specific tension to the yarn being withdrawn.

The operation of the intermediate feeder of FIGS. 1 to 5 as a demand feeder is thus as follows:

Yarn Y from a supply thereof as shown in full lines is guided outwardly of axially extending post 24 of winding member 20, through guide eyelets 31 and 32 and, upon rotation of winding member 20, the yarn is wound about storage member 16 forming windings which advance axially towards the opposite end of the storage member. The yarn being axially withdrawn from storage member 16, in response to the demand of yarn by the textile producing machine passes between disk 44 and outer ring 42, engaging successive resilient fingers 56 which are flxed thereby and which impart a uniform tension to the yarn, after which the yarn engages the outer surface of end plate 40, enters central aperture 76 thereof, reverses direction as it travels through the storage member on its way to the textile producing machine. The combination of the parameters of resilient fingers 56 plus the tortuous path presented by end plate 40 determine the total retarding force to which the yarn is subjected as it travels toward the textile producing machine. It is understood, as previously described, that the tortuous path can be varied by moving the end cap axially with respect to the storage member in one direction or another to increase or decrease the total tension as may be desired.

Figures 10A, 10B:
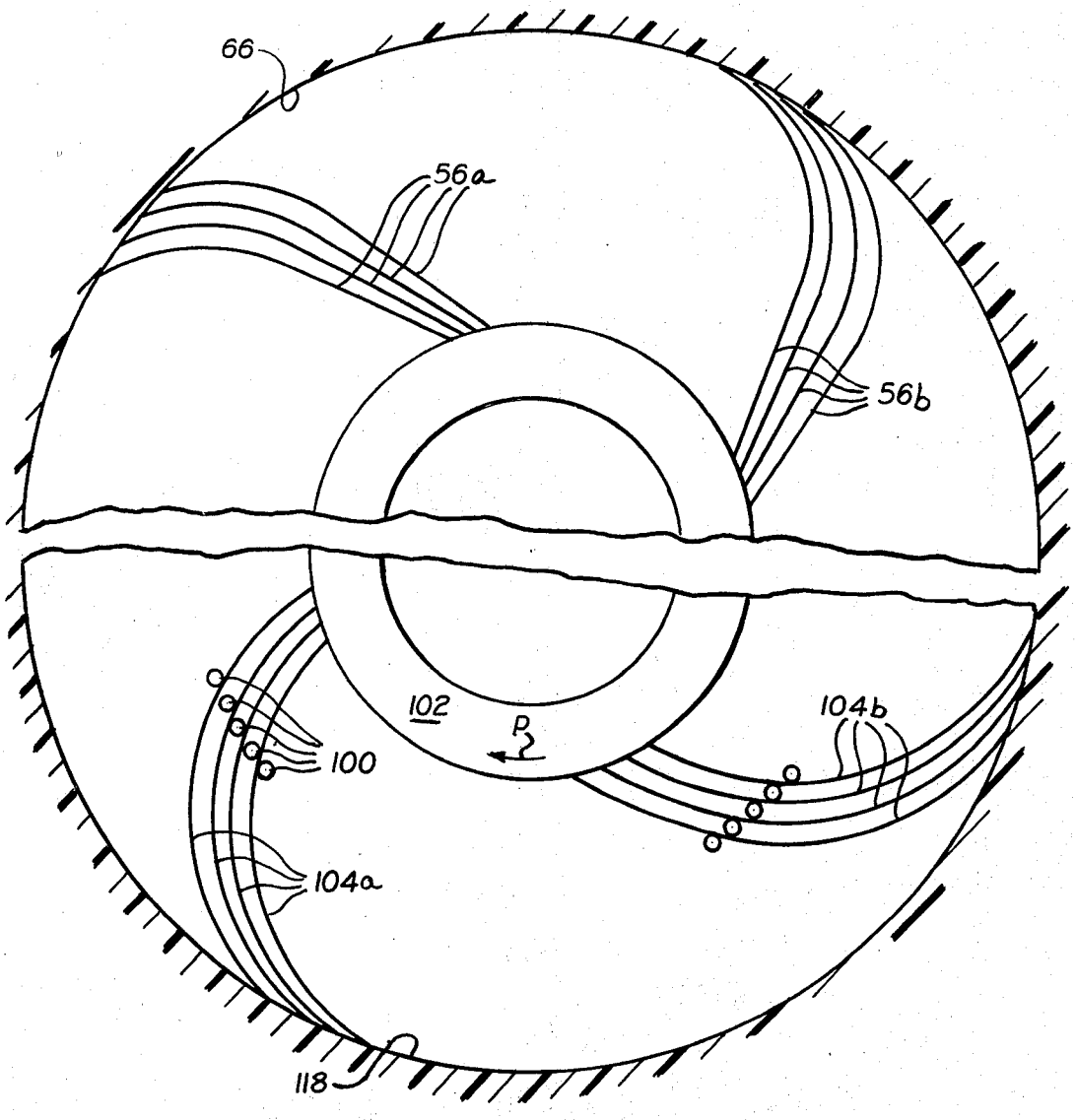
FIGS. 10A and 10B are schematic drawings illustrating the operation of both embodiments in accordance with the invention.

FIG. 10A illustrates, schematically, the manner in which the length of the resilient fingers affects the tension imparted to the yarn with resilient fingers **56*a* being identical to fingers 56*b* except only that the latter are slightly longer. In the case of fingers 56*a*, they are slightly curved when received in seat 66 while in the case of longer fingers 56*b*, the curvature caused by seat 66 is greater, increasing the stored energy in fingers 56*b* as well as creating a larger bunching effect of the fingers at the seat whereby the tension imparted to the yarn by fingers 56*b* is greater than that imparted by the shorter fingers 56*a***.

It will be understood that feeler 78 cooperates with appropriate electrical circuitry to control the rotation of winding member 20 so as to maintain the number of windings on the storage member within a predetermined range. It will also be noted that when feeding device 10 is operated as a demand feeder in the manner aforedescribed, yarn Y being axially withdrawn from the drum travels in a path which is clear of inwardly extending portion 27 of axially extending post 26 of the winding member so that such portion imposes no restraint whatsoever on yarn travel.

When it is desired to operate feeding device 10 as a positive feeding device wherein the yarn is removed from the storage member at a rate no greater than the winding speed, which is related to the rotational speed of the knitting machine, yarn Y is rethreaded as shown by the broken lines in FIG. 2 wherein the yarn removed from the storage member passes outwardly of outer ring member 42 on its way to guide aperture 76 and back into the storage member on its way to the knitting machine. Such rethreading of yarn Y results in the yarn travelling in a path which is restrained by inwardly extending portion 27 of winding member 20 so as to limit the withdrawal rate to that of the winding rate, resulting in the operation of intermediate feeding device 10 as a positive feeding device. In this connection, it will be understood that when yarn Y is threaded for positive feed operation, the operator of the device makes such appropriate electrical switching connection to render feeler 78 ineffective and to cause winding member 20 to continuously wind at a rate which is directly related to the rotational rate of the knitting machine.

Thus it is seen that retarding device 34 is eminently well suited to define uniform tensioning means for the yarn being withdrawn axially from its storage member, as demanded by the textile producing machine, particularly where the axially withdrawn yarn travels in a path wherein it reverses direction and passes through the storage member on its way to the textile producing machine. Further, it will be seen that such retarding device, in conjunction with winding member 20, functions selectively to define one yarn travel path, for demand feeding, in which the yarn is subjected to the retarding action of the bristle-like resilient fingers, or to define another yarn travel path, for positive feeding in which the yarn retarding resilient fingers are bypassed and in which, simultaneously, the resulting yarn travel is in the path of winding member restraining portion 27 in order to limit the yarn being withdrawn to a rate directly related to the rate of the knitting machine. While restraining portion 27 extends inwardly of post 26 located diametrically opposite to post 24, it will be understood that a similar result can be obtained by providing post 24 with an inwardly extending portion for restraining the yarn withdrawn to a rate no greater than the winding rate thereby dispensing with the necessity of post 26 altogether.

Figure 6:
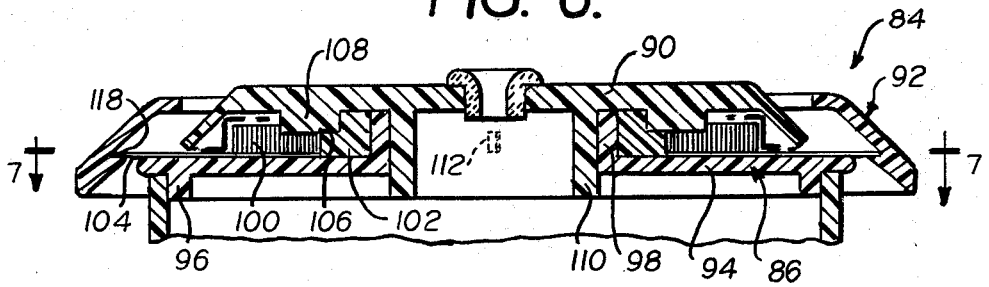
FIG. 6 is a view similar to FIG. 2, with parts broken away, illustrating another embodiment of a retarding device in accordance with the invention.
Figure 7:
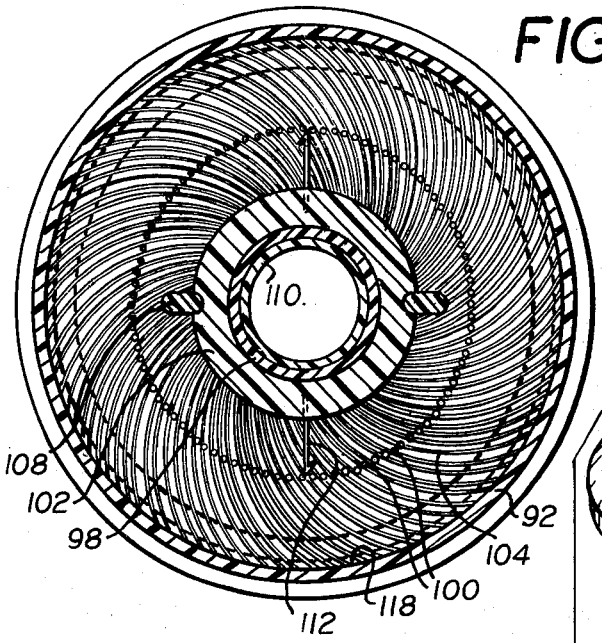
FIG. 7 is a sectional view taken along lines 7—7 of FIG. 6.
Figure 8:
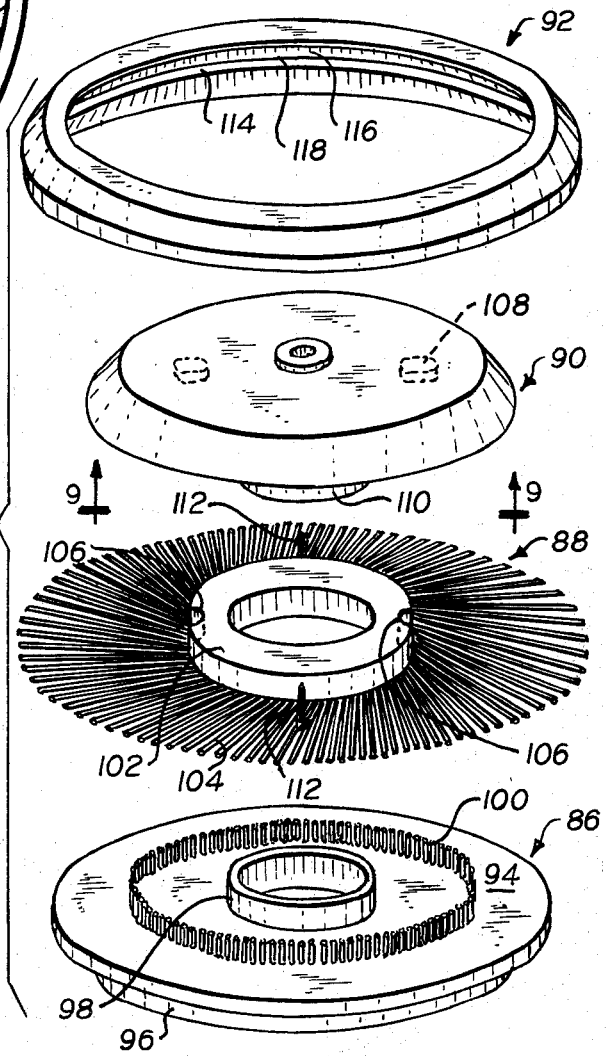
FIG. 8 is an exploded view of the retarding device in accordance with the embodiment of FIG. 6.
Figure 9:
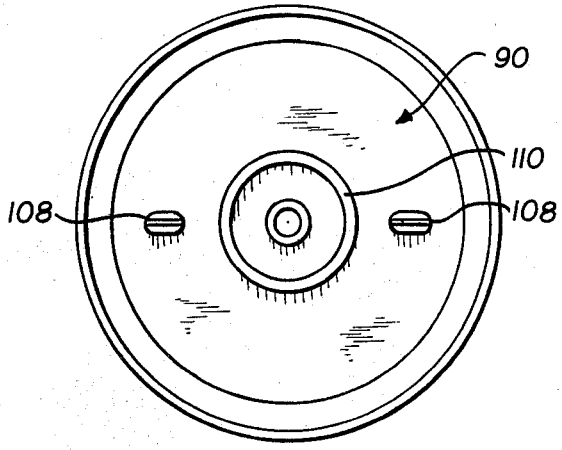
FIG. 9 is a bottom plan view taken along line 9—9 of FIG. 8.

Referring now to FIGS. 6 through 9, there is shown another embodiment of a retarding device 84 in accordance with the invention adapted for use with intermediate feeding device 10. Retarding device 84 comprises storage member cover plate 86, resilient finger carrying member 88, end plate 90, and outer ring member 92, all of which are best shown in the exploded view of FIG. 8. Cover plate 86 comprises annular disk 94, peripheral skirt 96 and unthreaded hub 98. Projecting upwardly from disk 94 are a plurality of circumferentially spaced upstanding pins 100 intermediate hub 98 and the outer periphery of disk 94. Cover plate 86 is press fit into the open end of storage member 16 with disk 94 projecting outwardly of storage member 16. Resilient finger carrying member 88 is substantially similar to previously described member 38 and comprises annular element 102, the bottom surface of which is provided with a plurality of outwardly and angularly extending resilient fingers 104. The number of resilient fingers 104 corresponds to the number of upstanding pins 100 on disk 94 so that when resilient finger carrying member 88 is supported by disk 94, each resilient finger 104 extends between two adjacent pins. Accordingly, relative rotation between annular element 102 and disk 94 will cause flexing of resilient fingers 104 as will more fully be described hereafter. In order to facilitate rotation of annular element 102 relative to hub 98, annular element 102 is provided with keyways 106 for receiving mating keys 108 projecting downwardly from end plate 90. Thus, when retarding device 84 is assembled as shown in FIG. 6, rotation of end plate 90 causes rotation of annular element 102 relative to hub 98, thereby flexing resilient fingers 104. Viewing FIG. 8, it will be seen that counterclockwise rotation of end plate 90 will cause uniform flexing of all resilient fingers 104. In all other respects, end plate 90 is similar to previously described end plate 40 except only that its hub 110 is not threaded and is instead freely rotatable relative to hub 98 of cover plate 86. In order to retain resilient finger carrying member 88 in predetermined relative position with respect to cover plate 86, annular element 102 is provided with a pair of outwardly extending flexible detents 112 whose outer V-shaped ends are adapted to be resiliently retained between a pair of pins 100. Outer ring 92 is in all respects similar to previously described outer ring 52, having lateral shoulder 114 and inner peripheral wall 116 defining therebetween resilient finger receiving seat 118, as best shown in FIG. 9.

FIG. 10B illustrates, schematically, the manner in which the yarn tension can be varied in retarding device 84 by pre-flexing resilient fingers in response to the rotation of annular element 102 relative to pin carrying disk 94. Resilient fingers 104a, though disposed between pins 100, are not pre-flexed thereby and assume their curvature only as a result of having their extremities received into seat 118 whose diameter is smaller than that collectively defined by the finger extremities, similar to the manner described in connection with the embodiment of FIGS. 1–5. Resilient fingers **104*b* on the other hand, though being precisely of the same length as fingers 104a have been pre-flexed by clockwise rotation of annular element 102 relative to disk 94 as shown by arrow P. Such preflexing of the resilient fingers diminishes the amount of resistance presented thereby to the traveling yarn which has thus less tension imparted thereto as it flexes successive fingers when it is withdrawn from the storage member outer surface. Thus it is seen that with any given resilient finger carrying member 88, substantial variations in tension to be imparted to the yarn can be obtained by selective relative rotation of resilient finger carrying member 88 with respect to disk 94.**

It will also be noted that insofar as conversion from demand feed to positive feed is concerned, retarding device 84 functions precisely in the same manner as retarding device 34, with the yarn being passed between outer ring 92 and disk 94 for demand feeding, or alternately, with the yarn being passed outwardly of outer ring 92 for positive feeding in which it forces the yarn to travel in the path of restraining inwardly extending portion 27 of winding member 20.

While retarding devices 34 and 84 have been described as including components 36 and 86, respectively, which also define the closure of the hollow storage member, it will be understood that the storage member may be provided with a closure independent of the retarding device but which is adapted to appropriately receive and support a retarding device such as that shown in the embodiment of FIGS. 1 to 5 or that shown in the embodiment of FIGS. 6 through 9. It will also be understood that the various components forming the yarn feeding device and the retarding devices illustrated herein, while shown as made of plastic, can equally well be made of some other suitable metallic or other material.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of this invention within the scope of the appended claims.

What I claim is:

1. In a yarn feeding device wherein yarn windings are formed on a storage member adjacent one end thereof and the yarn is thereafter withdrawn therefrom adjacent the other end thereof, means for imparting preselcted tension to the yarn being withdrawn comprising, a. a plurality of resilient fingers carried by support means therefor disposed adjacent said other end of said storage member, said fingers extending outwardly of said support means and projecting beyond the outer periphery of said storage member, b. an outer ring having an inner wall provided with a peripheral seat for receiving the outermost portions of said resilient fingers which constitute the means of support for said outer ring, said outermost portions of said resilient fingers, when the resilient fingers are in relaxed condition, collectively defining a circle whose diameter is greater than the diameter of said peripheral seat therefor, c. the withdrawn yarn being passed between said outer ring and the outer periphery of said storage member whereby as the yarn is withdrawn it flexes successive resilient fingers which impart thereto a preselected tension.

2. The device in accordance with claim 1, wherein said storage member includes a cover plate at said other end thereof, said cover plate having a central hub extending axially of said storage member.

3. The device in accordance with claim 2, wherein said support means for said plurality of resilient fingers comprises an annular member, supported by said cover plate in surrounding relation with said hub, said annular member having secured thereto said outwardly extending resilient fingers.

4. The device in accordance with claim 3, wherein said resilient fingers, when in relaxed condition, are substantially rectilinear.

5. The device in accordance with claim 4, wherein said resilient fingers form an angle of approximately 45° with a radius of said annular member passing through the inner ends of said fingers.

6. The device in accordance with claim 3, wherein said cover plate is provided with a plurality of pins between adjacent ones of which said resilient fingers extend, said annular member being rotatable relative to said cover plate whereby rotation of said annular member causes said resilient fingers to be flexed by said pins.

7. The device in accordance with claim 6, wherein there is provided an end plate supported by said cover plate for rotation relative thereto, and cooperating means on said end plate and said annular member for causing said end plate and said annular member to rotate in unison relative to said cover plate whereby manual rotation of said end plate causes rotation of said annular member for selectively flexing said resilient fingers.

8. The device in accordance with claim 7, wherein said cooperating means comprise keyways on said annular member and complementary keys on said end plate.

9. The device in accordance with claim 2, wherein said storage member has an internal passage and wherein the yarn withdrawn from said storage member reverses direction and enters said internal passage of the storage member.

10. The device in accordance with claim 9, wherein there is provided a centrally apertured end plate carried by said cover plate and having an outer side wall, the yarn withdrawn from the storage member being adapted, after flexing said resilient fingers, to engage said outer side wall and pass through the central aperture of said end plate prior to its entry in the internal passage of said storage member, whereby said outer side wall defines a tortuous path which imparts resistance to the yarn being withdrawn.

11. The device in accordance with claim 10, wherein there is further provided means for selectively positioning said end plate relative to said cover plate for selectively adjusting said tortuous path.

12. The device in accordance with claim 10, wherein the central hub of said cover plate is internally threaded and said end plate includes an externally threaded hub adapted to be threaded into said cover plate central hub for adjustable positioning of said cover plate relative to said end plate whereby said tortuous path is selectively adjustable.

13. The device in accordance with claim 1, wherein there is provided means for adjustably flexing said resilient fingers.

14. A yarn control device for controlling the feeding of yarn to a textile machine comprising, a. yarn storage means, b. means co-acting with said yarn storage means for causing yarn to be wound on said yarn storage member adjacent one end thereof to form a plurality of windings which advance toward the other end of said storage means, c. yarn guide means disposed adjacent said other end of said storage means for guiding the yarn being withdrawn from the storage means, said yarn guide means having means defining two separate selective paths for the yarn travel, and d. said co-acting means including a portion separate and distinct from said yarn guide means which restrains the yarn withdrawal to a preselected rate when said yarn is guided through one of said guide means paths and which portion is clear of said yarn withdrawal travel when said yarn is guided through the other of said guide means paths for permitting yarn to be axially withdrawn from said storage member at any desired rate.

15. The yarn control device in accordance with claim 14, wherein said yarn guide means comprise:

a. a plurality of resilient fingers carried by support means therefor disposed adjacent said other end of said storage means, said fingers extending outwardly of said support means and projecting beyond the outer periphery of said storage means, b. an outer ring having an inner wall provided with a peripheral seat for receiving the outermost portions of said resilient fingers which constitute the means of support for said outer ring, said one of said guide means paths for yarn travel being defined between said outer ring and the outer periphery of said storage means and said other of said guide means paths for yarn travel being defined outwardly of said outer ring, whereby when said yarn travels through said one path said yarn flexes successive resilient fingers which impart thereto a preselected tension.

16. The device in accordance with claim 15, wherein the outermost portions of said resilient fingers, when the resilient fingers are in relaxed condition, collectively define a circle whose diameter is greater than the diameter of said peripheral seat therefor.

17. The device in accordance with claim 16, wherein there is provided means for adjustably flexing said resilient fingers.

18. The device in accordance with claim 15, wherein said storage means includes a cover plate at said other end thereof, said cover plate having a central hub extending axially of said storage means.

19. The device in accordance with claim 18, wherein said support means for said plurality of resilient fingers comprises an annular member, supported by said cover plate in surrounding relation with said hub, said annular member having secured thereto said outwardly extending resilient fingers.

20. The device in accordance with claim 19, wherein said resilient fingers, when in relaxed condition, are substantially rectilinear.

21. The device in accordance with claim 20, wherein said resilient fingers form an angle of approximately 45° with a radius of said annular member passing through the inner ends of said fingers.

22. The device in accordance with claim 19, wherein the outermost portions of said resilient fingers, when the resilient fingers are in relaxed condition, collectively define a circle whose diameter is greater than the diameter of said peripheral seat therefor.

23. The device in accordance with claim 19, wherein said cover plate is provided with a plurality of pins between adjacent ones of which said resilient fingers extend, said annular member being rotatable relative to said cover plate whereby rotation of said annular member causes said resilient fingers to be flexed by said pins.

24. The device in accordance with claim 23, wherein there is provided an end plate supported by said cover plate for rotation relative thereto, and cooperating means on said end plate and said annular member for causing said end plate and said annular member to rotate in unison relative to said cover plate whereby manual rotation of said end plate causes rotation of said annular member for selectively flexing said resilient fingers.

25. The device in accordance with claim 24, wherein said cooperating means comprise keyways on said annular member and complementary keys on said end plate.

26. The device in accordance with claim 14, said yarn storage means being stationary and said co-acting means comprising a winding member adapted to rotate about said stationary yarn storage means for winding yarn thereon.

27. The device in accordance with claim 26, wherein said winding member includes a post extending axially of and in radially spaced relation with the storage means, said post having means for guiding the yarn from a supply thereof to a point adjacent said one end of said storage means for winding said yarn onto said storage means adjacent said one end thereof.

28. The device in accordance with claim 27, wherein said winding means includes another post, spaced from said first mentioned post, and extending axially of and in radially spaced relation with said storage means, said co-acting means portion extending from said another post inwardly toward said storage means.

29. A yarn control device for controlling the feeding of yarn to a textile machine comprising:

a. yarn storage means, b. means co-acting with said yarn storage means for causing yarn to be wound on said yarn storage means adjacent one end thereof to form a plurality of windings which advance toward the other end of said storage means, c. said storage means having an internal passage through which the yarn wound onto said storage means travels as it is withdrawn from the storage means adjacent said other end thereof, d. yarn guide means disposed adjacent said other end of said storage means for guiding the yarn into said internal passage, said yarn guide means having means defining two separate selective paths for the yarn travel, and e. said co-acting means including a portion separate and distinct from said yarn guide means which restrains the yarn withdrawal to a preselected rate when said yarn is guided through one of said guide means paths and which portion is clear of said yarn withdrawal travel when said yarn is guided through the other of said guide means paths for permitting yarn to be axially withdrawn from said storage means at any desired rate.

30. The device in accordance with claim 29, wherein said yarn guide means comprise:

a. a plurality of resilient fingers carried by support means therefor disposed adjacent said other end of said storage means, said fingers extending outwardly of said support means and projecting beyond the outer periphery of said storage means, b. an outer ring having an inner wall provided with a peripheral seat for receiving the ends of said resilient fingers which constitute the means of support for said outer ring, said one of said guide means paths for yarn travel being defined between said outer ring and the outer periphery of said storage means and said other of said guide means paths for yarn travel being defined outwardly of said outer ring, whereby when said yarn travels through said one path said yarn flexes successive resilient fingers which impart thereto a preselected tension.

31. The device in accordance with claim 30, wherein said storage means includes a cover plate at said other end thereof, said cover plate having a central hub extending axially of said storage means.

32. The device in accordance with claim 31, wherein said support means for said plurality of resilient fingers comprises an annular member, supported by said cover plate in surrounding relation with said hub, said annular member having secured thereto said outwardly extending resilient fingers.

33. The device in accordance with claim 32, wherein there is provided a centrally apertured end plate carried by said cover plate and having an outer side wall, the yarn withdrawn from the storage means being adapted, after flexing said resilient fingers, to engage said outer side wall and pass through the central aperture of said end plate prior to its entry in the internal passage of said storage means, whereby said outer side wall defines a tortuous path which imparts resistance to the yarn being withdrawn.

34. The device in accordance with claim 33, wherein there is further provided means for selectively positioning said end plate relative to said cover plate for selectively adjusting said tortuous path.

35. The device in accordance with claim 33, wherein the central hub of said cover plate is internally threaded and said end plate includes an externally threaded hub adapted to be threaded into said cover plate central hub for adjustable positioning of said cover plate relative to said end plate whereby said tortuous path is selectively adjustable.

36. The device in accordance with claim 30, said yarn storage means being stationary and said co-acting means comprising a winding member adapted to rotate about said stationary yarn storage means for winding yarn thereon.

37. The device in accordance with claim 36, wherein said winding member includes a post extending axially of and in radially spaced relation with the storage means, said post having means for guiding the yarn from a supply thereof to a point adjacent said one end of said storage means for winding said yarn onto said storage means adjacent said one end thereof.

38. The device in accordance with claim 37, wherein said winding means includes another post, spaced from said first mentioned post, and extending axially of and in radially spaced relation with said storage means, said co-acting means portion extending from said another post inwardly toward said storage means.

39. Means for imparting preselected tension to yarn being withdrawn from a storage drum having yarn windings thereon comprising, a. a plurality of resilient fingers carried by support means therefor, said fingers extending outwardly of said support means, b. an outer ring having an inner wall provided with a peripheral seat for receiving the outermost portions of said resilient fingers which constitute the means of support for said outer ring, said outermost portions of said resilient fingers, when the resilient fingers are in relaxed condition, collectively defining a circle whose diameter is greater than the diameter of said peripheral seat therefor, c. whereby as the withdrawn yarn passes between said outer ring and said support means, it is adapted to flex successive resilient fingers which impart to the withdrawn yarn a preselected tension.

40. A device in accordance with claim 39, wherein there is provided means for adjustably flexing said resilient fingers.

41. A device in accordance with claim 39, wherein said resilient fingers, when in relaxed condition, are substantially rectilinear.

42. A device in accordance with claim 41, wherein said resilient fingers form an angle of approximately 45° with a radius of said annular member passing through the inner ends of said fingers.

43. A device in accordance with claim 41, wherein there is provided means for adjustably flexing said resilient fingers.

* * * * *